United States Patent [19]

Clark et al.

[11] 4,440,317

[45] Apr. 3, 1984

[54] STERILE LIQUID STORING AND DISPENSING APPARATUS

[75] Inventors: James A. Clark, Honeoye Falls; Henry J. Emmel, Irondequoit, both of N.Y.

[73] Assignee: Bausch & Lomb Incorporated, Rochester, N.Y.

[21] Appl. No.: 297,383

[22] Filed: Aug. 28, 1981

[51] Int. Cl.[3] ..... B65D 35/28

[52] U.S. Cl. ..... 222/103; 222/105

[58] Field of Search ..... 222/92, 95, 96, 103, 222/105, 107, 386.5, 387, 94; 206/806; 220/408, 220/410

[56] References Cited

U.S. PATENT DOCUMENTS

| | | | |
|---|---|---|---|
| 2,903,161 | 9/1959 | Stahmer | 222/105 X |
| 3,744,674 | 7/1973 | Funke | 222/103 |
| 4,098,434 | 7/1978 | Uhlig | 222/94 |
| 4,163,509 | 8/1979 | Amneus | 222/95 |
| 4,228,925 | 10/1980 | Mendelovich | 222/103 |

*Primary Examiner*—Joseph J. Rolla
*Assistant Examiner*—Michael S. Huppert
*Attorney, Agent, or Firm*—Bernard D. Bogdon; John S. Norton

[57] ABSTRACT

An apparatus for storing and selectively dispensing sterile liquids comprises a liquid filled sealed flexible bag which has an integral dispensing spout formed therein. The flexible bag is received within a two piece housing which has spring mechanism to engage and exert pressure on the bag once the two pieces of the housing are closed together. A valve is mounted to the housing and engages the spout of the bag, effectively closing off the dispensing orifice of the spout. The valve is operable to move away from the spout to selectively dispense the pressurized sterile liquid from the bag.

11 Claims, 8 Drawing Figures

102
4
4

STERILE LIQUID STORING AND DISPENSING APPARATUS

BACKGROUND OF THE INVENTION

The present invention relates to an apparatus for storing and selectively dispensing sterile liquids from a sealed container disposed within a housing which has a spring mechanism for pressurizing the liquid within the container.

Relatively recent developments in contact lenses have produced a contact lens which is manufactured from soft, pliable materials. These soft contact lenses offer many desirable features to the wearer, such as: extended period wear, increased comfort, oxygen permeability, etc. These features have proved to be extremely popular with a large segment of the populace who wear vision correcting apparatus such as hard contact lenses or spectacles. However, because the soft contact lenses are produced from relatively fragile materials they are susceptible to damage or deterioration unless they are properly cleaned and treated on a regular basis. A preferred cleaning treatment requires that the wearer rinse the lenses with a sterile saline solution. The lenses are then cleaned with a further solution to remove deposits from the lenses. Thereafter, the lenses are inserted into a carrying case which contains a quantity of sterile saline solution. The carrying case is then placed in a heating apparatus and the lenses are subjected to sufficient heat for an appropriate period of time to properly disinfect them for future wear.

The delicate nature of the soft contact lenses make them much more susceptible to damage than contact lenses made from hard materials. Therefore, the rinsing solutions and cleaning techniques used are very important and must be performed properly for the integrity of the lenses to be maintained.

The proper rinsing of soft contact lenses is essential to insure that substantially all of the cleaning solutions and other foreign substances are removed from the lenses before the lenses are inserted in the eyes of the wearer. If the proper cleaning and rinsing procedures are not followed the wearer may suffer from eye irritation, inflammation or worse.

It should be noted that the present invention, while intended to be used in conjunction with the cleaning and rinsing of soft contact lenses, may easily be used in the cleaning and rinsing maintenance procedures required by the hard contact lenses.

It, therefore, is fairly evident that as the number of people who wear soft contact lenses continues to increase dramatically, the need for proper cleaning tools and materials also continues to rise.

Many of the containers used for storing and dispensing sterile saline solutions comprise squeeze bottles which the user would normally use by inverting the bottle and squeezing the sides which, in turn, forces the sterile solution out of the dispensing orifice. There is no provision with this type of container to keep it in an upright position while dispensing the liquid, nor is there any provision to dispense more solution than can be emitted with a single squeeze. If more solution is required, the user must continually release pressure so the sides of the bottle may again be squeezed to force out another stream of liquid, the velocity of which will initially be intense and then taper off.

A further drawback to a squeeze-bottle arrangement is that as the squeezing pressure is released, air is drawn back into the bottle. This allows outside contaminants to enter the bottle and to, perhaps, contaminate the contents of the bottle.

Other containers are readily available on the marketplace which are specifically designed for dispensing sterile unpreserved saline solution. This type of container is generally referred to as "unit dose" or "single dose" and is specifically packaged for people who, for whatever reason, cannot tolerate the preserved saline solution. As the name implies, the contents of this type of container must be used entirely after the container is opened, or whatever remains of the unpreserved solution must be thrown away. This is because the solution in the dispenser is unpreserved and once the container is opened it is subject to contamination by being exposed to outside elements. If the unpreserved saline solution is allowed to be reused the contents may be contaminated and the user would unnecessarily be subjecting himself to the possibility of eye irritation or infection.

Because the container is for a single dose, each dispenser must be individually packaged which increases the cost of the solution dramatically. The amount of material needed to package the solution is quite high when compared to the volume of the solution being packaged. The material generally contains aluminum foil which prevents the solution from permeating out the container walls and is quite costly to manufacture per unit volume of solution packaged.

A further container has been introduced to the marketplace which claims to prevent oxygen and contaminants from entering the container. This container has a bellows body with a one-way valve at the top. As pressure is applied to the bellows body by the user, the material in the container is forced up to the one-way valve, which then opens to emit the liquid. As pressure is released from the bottle, the valve closes and restricts the liquid flow. It would appear that the one-way valve of this container is formed from an elastic material that has memory. That is, as pressure is applied to the bellows the valve material distorts to cause an opening for the liquid to pass through. When pressure is released from the bellows the memory of the elastic valve causes it to return to its original shape, which in turn closes the aperture, stopping the liquid flow.

In this type of bottle a substantial amount of pressure will have to be applied to the bellows in order to overcome the memory of the valve to cause it to open. Once the valve is open, the pressure must be maintained by the user or the flow of liquid will cease.

A further drawback to the above type of fluid dispenser is that when pressure is released from the bellows the valve does not immediately close. This allows outside contaminants to be drawn back into the container, thereby contaminating the contents.

The liquid, or solution, storing and dispensing apparatus, comprising the present invention, overcomes the above-mentioned difficulties.

There have, of course, been other types of dispensing apparatus which have been used for dispensing various and sundry other types of solutions which run the gamut from house paints to water. However, dispensers for these liquids generally do not contemplate maintaining the sterility of the contained material nor do they offer the compactness or portability needed for dispensing sterile solutions, such as would be necessary for caring for contact lenses. Some examples of these types of dispensers are shown in U.S. Pat. No. 103,640 entitled "Improved Apparatus for Painting", issued to A. P. Merritt on May 31, 1870; U.S. Pat. No. 720,902 entitled "Apparatus for Making Relief Work" issued on Feb. 17, 1903 to H. Du Brau and U.S. Pat. No. 1,959,782 entitled "Water Carrier and the Like", issued to F. F. Fenwick, Jr. on May 22, 1934.

SUMMARY OF THE INVENTION

The present invention provides a housing that will hold and store sterile solutions carried in a flexible container within the housing for an extended period of time. The housing may be used as a dispenser for the sterile solution. The solution would be maintained in a sterile environment from original packaging by the manufacturer through shelf storage, both in the store and on the user's counter, until the last of the solution has been dispensed from the apparatus. The solution may either be preserved or unpreserved, depending on user's preference.

A two-piece housing, which may be hinged at the top, is configured to hold a flexible bag which has a quantity of sterile solution sealed inside. The bag is held in the housing so that a spout, or discharge nozzle portion, is positioned within an aperture in the housing. A valve member in the housing proximate the discharge nozzle portion of the bag which bears against this portion, effectively sealing it off.

A spring loading apparatus in the housing exerts a continual, essentially even, pressure against the sterile solution filled flexible bag when the two portions or halves of the housing are closed together.

When the dispenser is ready for use the end of the discharge nozzle beyond the valve member would be cut off, or otherwise removed, from the flexible bag spout creating an opening for the sterile solution once the valve is actuated. The user would then simply manipulate the valve so as to allow the discharge nozzle to open. The constant spring pressure against the flexible bag forces a continual stream of sterile solution from the bag until the valve closes the discharge nozzle. The housing is preferably designed to be small so that it may be hand held and easily stored when not in use. The housing would, however, be large enough to hold a sufficiently large quantity of liquid to insure that the user will not be stopping continually to refill the device. The sterile solution filled flexible bags are configured to be replaceable within the housing so that after the solution is dispensed from one bag it may be thrown away and another bag may be positioned in its place. The sterility of the solution is maintained from original packaging until the last of the solution has been dispensed from the bag.

The above, and other, advantages of the present invention will become fully evident upon reading the following detailed description making reference to the illustrations set forth in the accompanying drawings.

DETAILED DESCRIPTION OF THE PREFERRED EMBODIMENT

Figure 2:
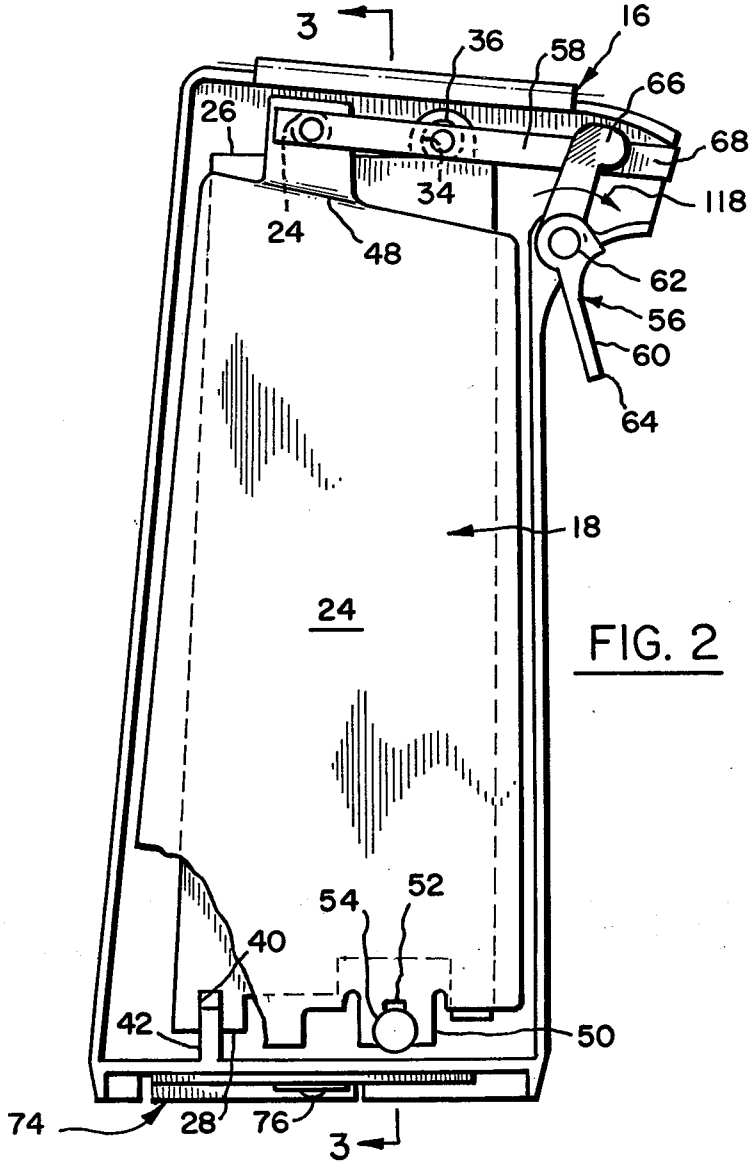
FIG. 2 is a side view of one half of the dispensing apparatus of FIG. 1 showing the valve and spring loading means.

The present invention which will be briefly set forth in the following paragraphs, a more detailed description of the operation to follow, comprises a housing 10 which has a first portion 12 and a second portion 14. The two portions may be joined together in any convenient manner, such as, for instance, by hinge member 16. By hinging the two portions 12 and 14 together at their top portion, as illustrated, each may respectively be swung away from the other to permit ready access to the inside of the housing 10.

Figures 3, 5, 6:
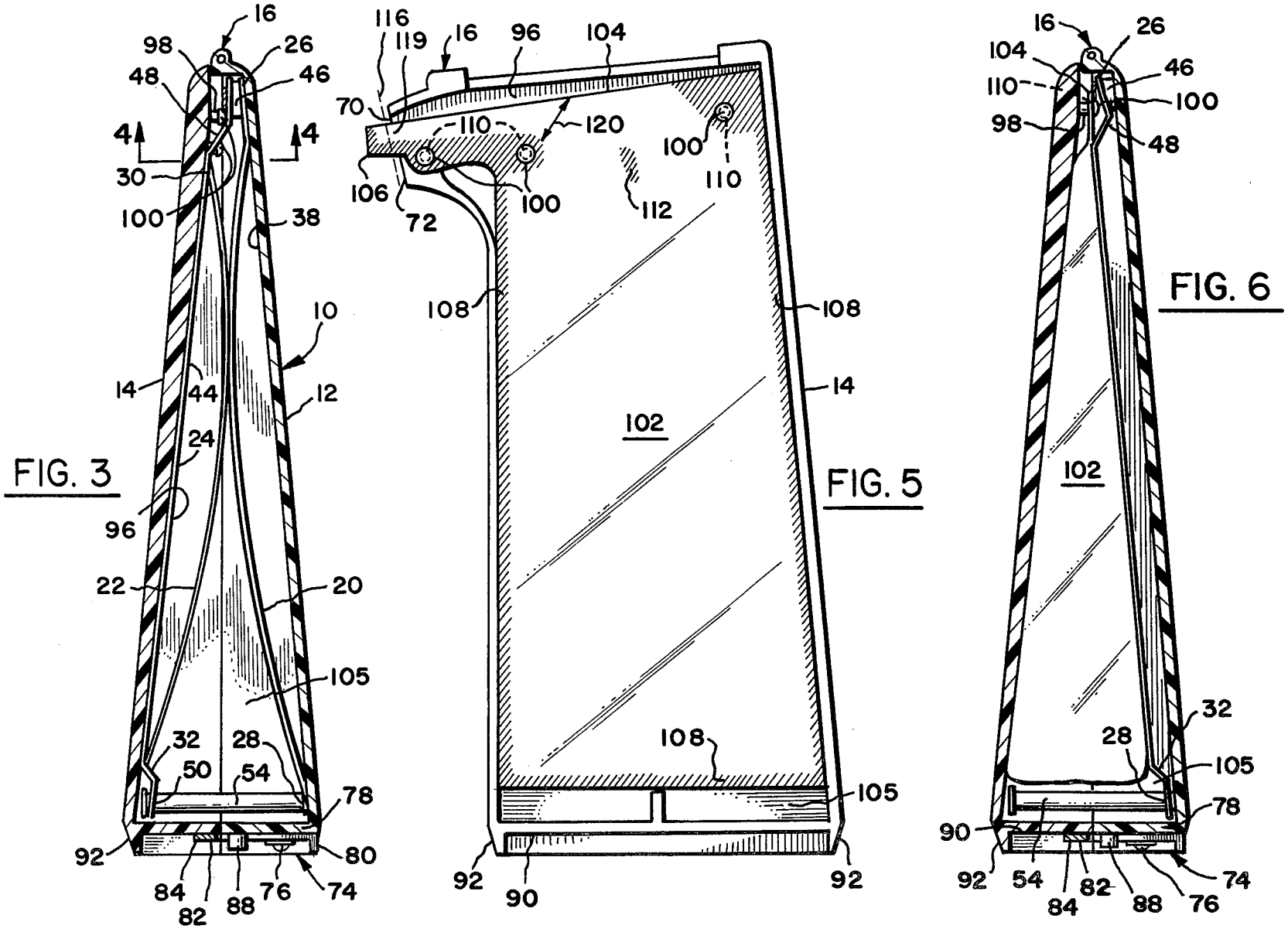
FIG. 3 is a sectional view taken along line 3—3 of FIG. 2.
FIG. 5 is a side view of the other half of the dispensing apparatus of FIG. 2 showing the liquid filled bag in place on locating pins.
FIG. 6 is a sectional view similar to FIG. 3 only having the liquid filled bag in position on the locating pins.

A spring loading apparatus 18 is positioned within housing 10 and comprises a pair of leaf springs 20 and 22 and a pressure plate 24, as best seen in FIG. 3. The leaf springs 20 and 22 are bowed and arranged to be connected together by any convenient manner somewhere along their bowed portions so that their end portions face away from each other. That is, the end portions 26, 28 of leaf spring 20 face away from the end portions 30, 32 of leaf spring 22, again, as best seen in FIG. 3.

End 26 of spring 20 has an aperture 34 sized to fit over a boss 36 formed on the inner surface 38 of housing portion 12. The opposite end 28 of spring 20 has a slot 40 which receives raised guide member 42 formed on the lower portion of the inner surface 38 of portion 12.

Ends 30, 32 of spring 22 are arranged to bear against surface 44 of pressure plate 24 which is pivotally secured at boss 46, which is juxtaposed to boss 36, to inner surface 38 of housing portion 12, as best seen in FIG. 2. The end 48 of the pressure plate 24 is flanged near the point where the pivotal connection to boss 46 occurs and serves to receive and limit the movement of the end portion 30 of spring 22. The opposite end 50 of the pressure plate 24 has a slot 52 which receives guide pin 54. The pin 54 is affixed, for instance, by any convenient method, to housing portion 12. Thus, the pressure plate 24 may pivot at boss 46 while sliding up and down on guide pin 54.

Figure 1:
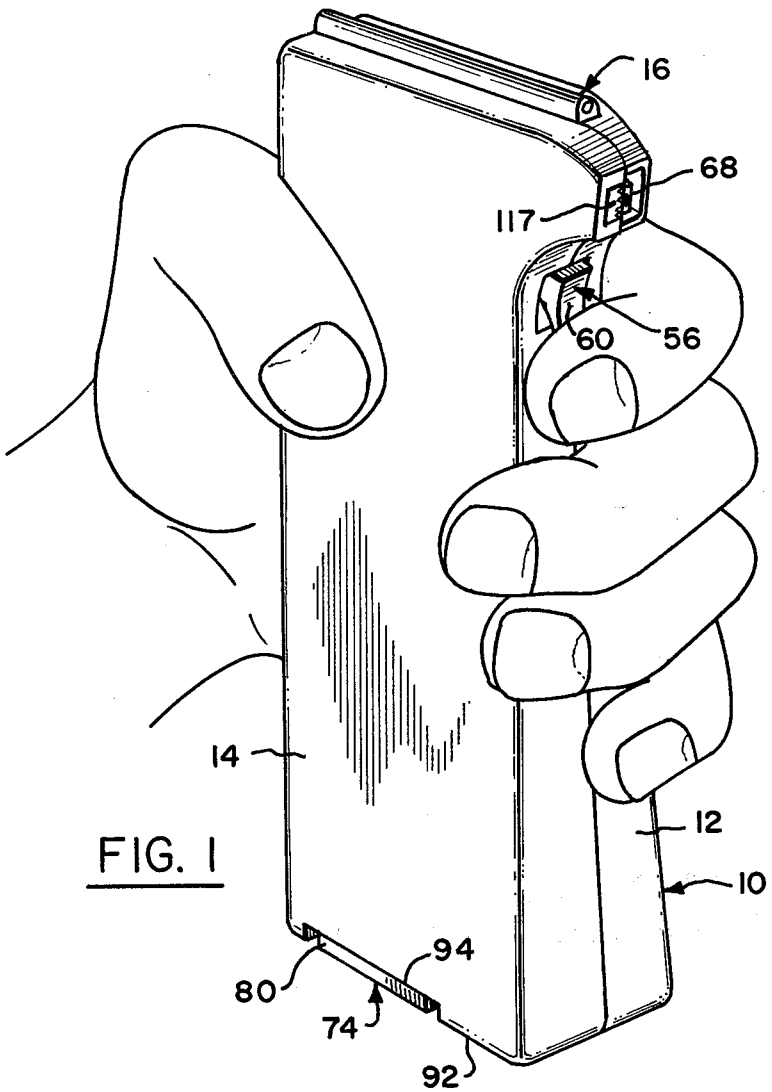
FIG. 1 is a perspective view of the dispensing apparatus according to the principles of the present invention.
Figure 4:
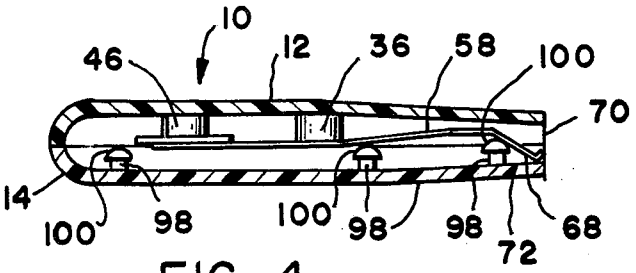
FIG. 4 is a sectional view of the dispensing apparatus taken along line 4—4 of FIG. 3.

A valve mechanism 56 comprises a pressure spring 58 and a trigger 60. The spring 58 is mounted to housing portion 12 to the bosses 36 and 46, as best seen in FIG. 4. The trigger 60 is pivotally mounted to housing portion 12 at point 62. The trigger consists of a first portion 64 which will accommodate the user's finger such as is illustrated in FIG. 1, and a second portion 66 to engage and bear against the distal end 68 of pressure spring 58. By referring to FIGS. 1, 4 and 8 it will be seen that the end 68 of spring 58 terminates at aperture 70 and bears against surface 72 of housing half 14.

Figure 8:
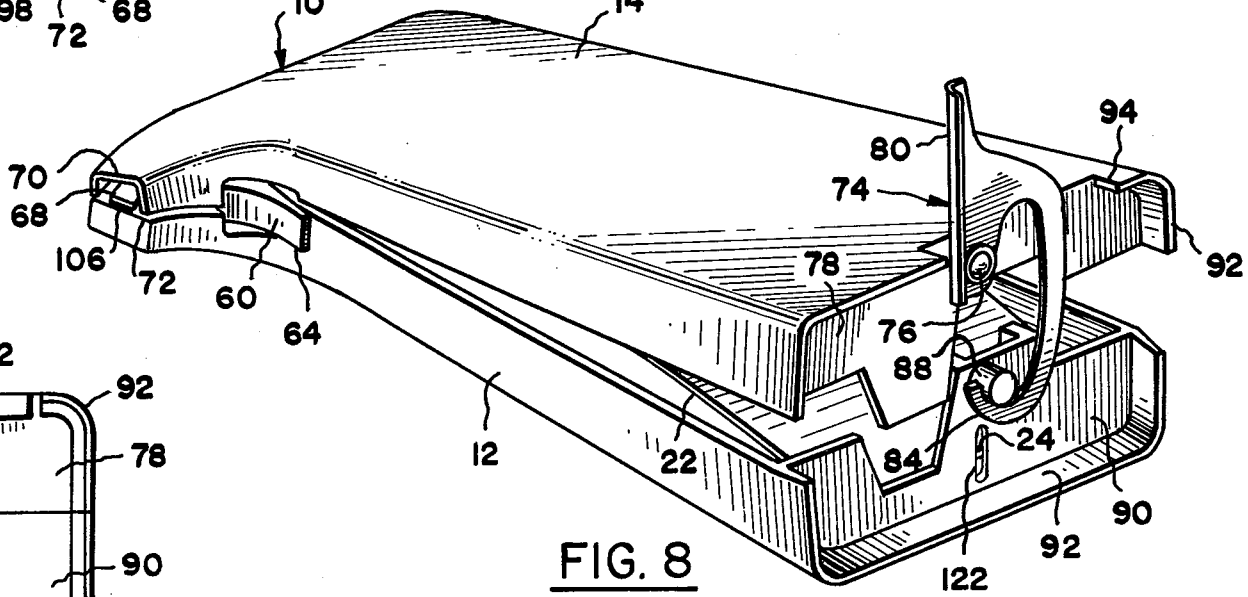
FIG. 8 is a perspective view of the bottom of the dispensing apparatus showing it in a partly opened manner.

An over-center catch member 74 is pivotally mounted at pivot 76 to the bottom 78 of housing portion 14. The catch member has a raised portion 80 and an elongated portion 82 which has a hook 84 formed at its end. A seat 86 is formed in the catch member 74 and is sized to accommodate a raised boss 88 which is formed on bottom portion 90 of housing portion 12. The bottom portions 78 and 90 are recessed so that a raised section, or wall, 92 is formed. A notch 94 in wall 92 of housing portion 14 allows catch member 74 to be pivoted as shown in FIG. 8.

Formed on the inner surface 96 of housing portions 14 are a plurality of support pins 98 which project toward the center of the housing 10 when the portions 12 and 14 are closed together. The pins may have buttons, or mushroom-like surfaces 100 formed thereon.

The sealed flexible bag 102 is preferably manufactured from film plastic material which is folded over at seam 104 so that the nozzle portion 106 is readily formed. A heat seal 108 is then formed about the open sides of the bag and encompasses a plurality of apertures 110 which are formed in the bag. Alternately, the apertures 110 could, of course, be punched through the bag after the heat seal 108 has been effected. In either application, the bag 102 is effectively sealed. A further heat seal 112 may be added to the bag at approximately the position shown in FIG. 5, the significance of which will be more fully explained and understood by referring to the operational description set forth hereinafter.

The bag 102 is designed to fit within the cavity 105 formed in the housing 10 when the portions 12 and 14 are closed. The shape of the bag 102 is such that a discharge portion, or nozzle, 106 is provided which is received within, and extends from, aperture 72 of housing portion 14. The plurality of apertures 110 formed in the bag 102 are effectively positioned so that the bag may be pushed over the button heads 100 of support pins 98. The bag 102 is thus located in the housing 10 by the pins 98. The bag is prevented from slipping from the pins by the button heads 100 which are larger in diameter than the apertures 110 in the bag. The plastic composition of the bag allows the apertures 110 in the bag to expand and slide over the button heads 100 and then to, essentially, return to their original diameter.

Figure 7:
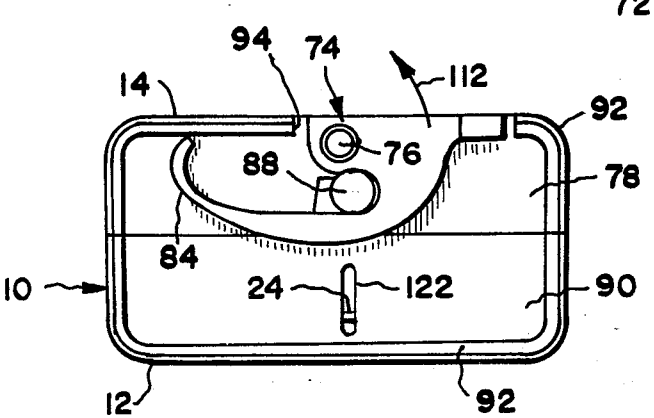
FIG. 7 is a bottom view of the dispenser showing a latching mechanism.

In operation, the user would first rotate the catch member 74 in the direction of arrow 112 from the position shown in FIG. 7 to the position shown in FIG. 8, where it will be seen that the hooked portion 84 engages, and is stopped by the raised boss 88. The spring pressure exerted by leaf springs 20 and 22 against pressure plate 24, which in turn bears against and forces housing portion 14 away from portion 12. The hooked portion 84 acts as a safety mechanism to prevent half 14 from springing entirely open which may startle the user. Once the two halves of the dispensing apparatus are opened to the position shown in FIG. 8 the user may simply put slight pressure on housing portion 14 to allow the hooked portion 84 of catch 74 to be moved away from boss 88. The catch 74 may now be rotated entirely away from the boss 88 and the two halves 12 and 14 may be separated from each other permitting ready access to the cavity 105.

The user would then take a liquid filled bag 102 and position it so that the plurality of apertures 110 align with the support pins 98 formed on surface 96 of housing half 14. The bag 102 is then pushed over the button heads 100 of the support pins 98 which automatically positions the bag in the housing and aligns nozzle 106 within aperture 70.

The two halves would now be rotated about hinge 16 so that they are closed together. By referring to FIG. 6 it will be seen that when the bag 102 is in position and the two housing portions closed together the leaf springs 20 and 22 compress toward each other and the pressure plate 24 slides down guide pin 54. The spring and pressure plate combination in this position exerts pressure on the liquid filled bag. The nozzle 106 is positioned in the aperture 70 so that the end 68 of spring 58 presses it against surface 72 of housing half 14. The user would now cut, or otherwise remove, the heat sealed portion of nozzle 106 at approximately the area shown by dotted line 116 in FIG. 5. This procedure creates an aperture or passageway 119 in the bag 102. Alternately, a serrated member 117, as best seen in FIG. 1, may be affixed to the housing 10 so that the nozzle end 106 could be pulled across it to thereby cut it from the bag.

In order to dispense liquid from the bag 102 the user would squeeze the first portion 64 of trigger 60 which causes second portion 66 to rotate in direction 118 toward and into direct engagement with distal end 68 of pressure spring 58. This in turn causes the spring end 68 to release the pressure it has been exerting on the bag nozzle 106 against surface 72. This effectively opens aperture 119 so that liquid may be dispensed. The constant pressure exerted by the leaf spring—pressure plate combination against the liquid filled bag 102 causes the liquid to be dispensed through the aperture 119 until such time as the user releases force from the trigger 60. The portion 66 of the trigger which is in engagement with the end 68 of spring 58 releases pressure therefrom and the aperture 119 is effectively resealed.

It has been found that, at various times, a crease, or kink, would appear in the bag 102 across the area which would be approximately indicated by numeral 120 in FIG. 5. This crease 120 acts to seal the passageway 119 which, of course, prevents the flow of liquid from the bag 102. The crease 120 would remain, in some instances, no matter how much, or how little, pressure was exerted against the bag. As suggested previously, if a small heat seal area was added to the bag 102 at about the area indicated by 112, the crease, or kink, 120 would not form and, consequently, the passageway 119 would remain open and essentially the entire liquid contents of the bag could be dispensed.

In order for the user to monitor the amount of liquid remaining in the bag 102 without having to open the housing 10, an inspection port 122 is provided in bottom 90 of housing half 12. The pressure plate 24 is viewable through this port. The user would then know when it is nearing time for the bag to be replaced with a new bag filled with the liquid desired to be dispensed.

It should be understood that presently a preferred embodiment of the dispenser has been described in illustrating this invention. This invention contemplates and includes all modifications and equivalents of the disclosed embodiment.

We claim:

1. A sterile liquid storing and dispensing apparatus, comprising:

a sealed flexible container for sterile liquids and having an integral dispensing spout therein;

a housing for said sealed flexible container, said housing including first and second portions being cooperatively engageable so as to facilitate access to and retention of said sealed flexible container, said housing further including an aperture therein being configured to receive said dispensing spout;

pressure means pivotally mounted to one of said first and second housing portions for engaging said sealed flexible container to exert a continual pressurizing force thereon when said sealed flexible container is positioned within said housing; and a selectively operable valve mounted in said housing so as to press against said dispensing spout to normally close said dispensing spout in a first position and being movable to a second position to release pressure to permit opening of said spout, said pressure means exerting continual pressure against said sealed flexible container and forcing liquid therefrom when said valve is in its second open position until said valve returns to its first closed position, the continual pressurizing force being exerted on said flexible container by said pressure means preventing outside contaminants from being transmitted back to the liquid within said sealed flexible container.

2. The sterile liquid storing and dispensing apparatus as set forth in claim 1, wherein said pressure means comprises at least one leaf spring and a pressure plate coacting therewith.

3. The sterile liquid storing and dispensing apparatus as set forth in claim 2, wherein said housing includes guide means for said pressure plate.

4. The sterile liquid storing and dispensing apparatus as set forth in claim 1, wherein said pressure means comprises a pair of bowed leaf springs and a pressure plate coacting therewith.

5. The sterile liquid storing and dispensing apparatus as set forth in claim 4, wherein one of said bowed leaf springs has a notch formed therein and one of said housing portions to which said pressure means is mounted includes thereon a guide member for reception in the notch.

6. The sterile liquid storing and dispensing apparatus as set forth in claim 1, wherein one of said first and second housing portions includes a latch member thereon, the other housing portion having a device provided thereon for engaging said latch member and stopping pivotal movement of said housing portions away from each other caused by the force being exerted against said housing portions and said sealed flexible container by said pressure means.

7. The sterile liquid storing and dispensing apparatus as set forth in claim 1, further including cutting means thereon proximate the aperture aligned with said sealed flexible container dispensing spout for removing a portion of said dispensing spout to thereby create a passageway through which sterile liquid may flow.

8. The sterile liquid storing and dispensing apparatus as set forth in claim 7, wherein said cutting means comprises a serrated member.

9. A sterile liquid storing and dispensing apparatus, comprising:

a sealed flexible container for sterile liquids comprising a plastic envelope having an integral dispensing spout, said sealed flexible container including a plurality of positioning holes extending through heat sealed portions of said envelope;

a housing for said flexible container including first and second portions which are cooperatively engaged to each other, one of said portions having a plurality of locater pins for respectively projecting through said plurality of positioning holes of said flexible container to properly orient said container within said housing, said housing being otherwise constructed and arranged to facilitate the insertion into, retention in and withdrawal of said sealed flexible container from said housing, said housing further having an aperture therein configured to locate and receive said spout;

pressure means within said housing for engaging said flexible container to exert a continual pressurizing force thereon when said flexible container is positioned within said housing; and a selectively operable valve mounted in said housing, said valve having a first position so as to normally close said liquid dispensing spout by maintaining pressure thereagainst and being selectively movable to a second position to permit opening of said spout, said pressure means exerting continual pressure on said flexible container thereby forcing liquid therefrom until said valve returns from its second position to its first closed position, the continual pressurizing force being exerted on said flexible container by said pressure means preventing outside contaminants from being transmitted back to the sterile liquid within said container.

10. The sterile liquid dispensing and storing apparatus as set forth in claim 9, wherein said flexible container has at least three sealed edges.

11. The sterile liquid storing and dispensing apparatus as set forth in claim 10, wherein said sealed flexible container has a further heat sealed area proximate the dispensing spout portion thereof, said further heat sealed area preventing kinking or creasing of the bag at that portion of said container.

* * * * *